United States Patent [19]

Harmon et al.

[11] 4,017,702

[45] Apr. 12, 1977

[54] MICROWAVE OVEN INCLUDING APPARATUS FOR VARYING POWER LEVEL

[75] Inventors: Larry R. Harmon, Jeffersontown; Donald J. Simon, Louisville, both of Ky.

[73] Assignee: General Electric Company, Louisville, Ky.

[22] Filed: July 30, 1975

[21] Appl. No.: 600,313

[52] U.S. Cl. ..... 219/10.55 B; 315/352; 323/79; 331/86

[51] Int. Cl.[2] ..... H05B 9/06

[58] Field of Search ..... 219/10.55 B; 321/15; 323/75 K, 79, 81; 331/86; 315/200 R, 238, 239, 241 R, 245, 276, 227 R, 352, 353

[56] References Cited

UNITED STATES PATENTS

| | | | |
|---|---|---|---|
| 2,799,809 | 7/1957 | Lautenberger | 321/15 X |
| 3,029,386 | 4/1962 | Ricker | 321/15 X |
| 3,350,623 | 10/1967 | Clapp | 323/79 X |
| 3,651,371 | 3/1972 | Tingley | 331/86 X |
| 3,684,978 | 8/1972 | Otaguro | 315/239 X |
| 3,780,252 | 12/1973 | Crapuchettes | 219/10.55 B |
| 3,792,369 | 2/1974 | Levinson | 219/10.55 B X |
| 3,842,233 | 10/1974 | Lamb | 219/10.55 B |
| 3,872,277 | 3/1975 | Niu | 219/10.55 B |
| 3,876,956 | 4/1975 | Levinson | 219/10.55 B X |

*Primary Examiner*—Arthur T. Grimley
*Attorney, Agent, or Firm*—Steven C. Schnedler; Francis H. Boos

[57] ABSTRACT

Apparatus for varying microwave power level is included in a microwave oven. The microwave oven includes a magnetron for producing microwaves used for heating and a half-wave voltage doubler for supplying half-wave pulsating DC voltage to the magnetron. In order to vary voltage and thus power output of the magnetron, the charging of the capacitor in the half-wave voltage doubler is controlled by a variable resistance connected in series with the rectifier in the otherwise conventional half-wave voltage doubler.

6 Claims, 4 Drawing Figures

MICROWAVE OVEN INCLUDING APPARATUS FOR VARYING POWER LEVEL

BACKGROUND OF THE INVENTION

1. Field of the Invention

The present invention relates generally to microwave ovens and more particularly to apparatus for varying the microwave power level of such an oven.

2. Description of the Prior Art

Prior art microwave ovens include a magnetron for producing microwave energy and a high voltage DC power supply for the magnetron. A well-known high voltage DC power supply circuit is the combination of a high voltage ferroresonant voltage regulating power transformer and a half-wave voltage doubler. A half-wave voltage doubler is frequently employed in microwave ovens because it is effective yet requires only a minimum number of components. In a conventional power supply of this type, a first terminal of a high voltage secondary winding of the power transformer is connected to the anode of the magnetron. Since commonly-used magnetrons are of the grounded-anode type and since one terminal of the high voltage secondary winding of commonly-available ferroresonant power transformers is connected to the metal frame of the transformer, the magnetron anode and the first terminal of the high voltage winding are conveniently connected to ground potential. A series capacitor is connected between a second terminal of the high voltage winding and the cathode of the magnetron. A rectifier is connected between the junction of the capacitor and the magnetron cathode and the first terminal of the high voltage winding, thereby placing the rectifier in parallel with the magnetron. The rectifier is polarized so that the rectifier anode is connected to the magnetron cathode and the rectifier cathode is connected to the magnetron anode. A primary winding of the power transformer is connected to a source of AC power, typically a 120 volt, 60 Hertz commercial power line.

In order to supply the magnetron, a conventional half-wave voltage doubler operates as follows to produce half-cycle DC voltage pulses having a peak voltage approximately equal to twice the peak voltage across the transformer high voltage winding. During positive half-cycle AC line excursions, that is during those portions of the AC cycle when the voltage at the second terminal of the high voltage winding is positive with reference to the voltage at the first (grounded) terminal of the high voltage winding, the rectifier conducts and the capacitor charges through the rectifier up to a voltage approximately equal to the peak voltage across the high voltage winding, the capacitor terminal connected to the rectifier anode receiving a negative voltage with reference to the capacitor terminal connected to the second terminal of the high voltage winding. During positive half-cycle AC line excursions, the magnetron does not conduct because the magnetron cathode is positive with reference to the magnetron anode. During negative half-cycle AC line excursions, the rectifier does not conduct and is therefore effectively out of the circuit. The negative voltage produced at the second terminal of the high voltage winding is added to the voltage stored in the series capacitor and the combined voltage is supplied to the cathode of the magnetron. The magnetron conducts during negative half-cycle AC line excursions because the magnetron cathode is negative with reference to the magnetron anode. Because the capacitor partially discharges through the magnetron during negative half-cycle AC line excursions, the voltage stored in the capacitor will not be maintained at its peak over an entire negative half-cycle excursion and the voltage supplied to the magnetron is therefore somewhat less than twice the peak voltage across the high voltage winding.

Preferably, the power transformer additionally includes a low voltage secondary winding for supplying power to energize a heater for the magnetron cathode. The magnetron may be either of the type including an indirectly heated cathode, in which case the cathode and the heater are separate elements, or it may be of the type including a directly heated cathode, in which case the heater and the cathode are the same element.

It is a desirable feature in a microwave oven to include means for varying the power level of the microwave energy produced by the magnetron. A low power level, typically one-half the full power level, is particularly useful for providing a defrosting mode. When frozen food is to be cooked in a microwave oven, it is preferable to heat the food slowly until it is completely thawed. If full power is applied when frozen food is in the oven, uneven heating and thawing may result, the end result being that some portions of the food may be completely cooked while others are still frozen. Low power heating permits the heat produced in the food as a result of microwave energy to be more evenly distributed throughout the food. In addition to providing a defrosting mode, it is desirable to provide a variable power level for added convenience when a microwave oven is to be used for cooking different types and sizes of food.

Prior art approaches to providing variable power level in a microwave oven, and more particularly to providing a power level less than the full power level, may be broadly described as two approaches: cycling and reduced voltage. In the cycling approach, full voltage is supplied to the magnetron on an intermittent basis. For example, if a 50% duty cycle is employed, then during any instant, voltage supplied to the magnetron and thus microwave power supplied to the food is either at a maximum or is zero, but the average power over a period of time is approximately 50% of the full power level. On and off times ranging from one second up to 30 seconds have been employed.

If the cycling approach is used, voltage supplied to the magnetron may be interrupted either by interrupting power supplied to the primary winding of the power transformer or by opening a conductor in the circuit connected to the high voltage winding. All of the systems employing the cycling approach suffer the disadvantage of complexity because at least timing means and switching means are required. In a practical system, additional elements with resultant complexity and expense may be required. For example, in order to prolong the life of the various components through frequent cycles, means to reduce initial surge currents and high voltage transients may be employed. In order to reduce surge currents, complex solid state control circuits having operation synchronized with the AC power line cycles may be used to control primary power to the transformer. If a relay or a conventional cam-operated switch is used to turn the power on and off, the contacts may deteriorate after a period of use and result in unreliable operation.

If a cycling approach is implemented by interrupting the power supplied to the transformer primary winding, either a separate, continuously energized filament transformer for the magnetron heater, with attendant cost and complexity, must be provided or the undesirable consequences of cycling the power supplied to the magnetron heater along with cycling the high voltage must be suffered. As is well known, the resultant frequent cyclic energizing and deenergizing of a magnetron heater will shorten the life expectancy of the magnetron. This is particularly so if "cold switching" is used. "Cold switching" is an operating procedure whereby heater power and anode high voltage are supplied simultaneously to the magnetron. Optimally, in order to provide the longest life, the magnetron heater should be energized before the high voltage is applied. However, in the event that a delay means to provide this function, together with its attendant complexity, is not included in the microwave oven and cold switching is therefore employed, it is desirable to limit the number of times during the operational life of the magnetron that it is cold switched.

In order to reduce the frequency of the cyclic energizing and de-energizing of the heater and the frequency of initial surge currents, relatively long on and off times, up to 30 seconds, have been employed. A further disadvantage of this approach is that, although the average power supplied to the food load is approximately ½ the full power level, there is substantial variation in the temperature of the food over a given period of time. The effectiveness of low power operation may thereby be partially lost.

Some of the disadvantages of implementing the cycling approach by interrupting the power supplied to the transformer primary winding may be eliminated by opening a conductor in the high voltage circuit connected to the transformer high voltage winding. If a high voltage vacuum relay is used, any of the conductors in the high voltage circuit, including a conductor in series with the rectifier, can be opened and will effectively interrupt the high voltage DC supplied to the magnetron without de-energizing the magnetron heater. Preferably, for safe and reliable operation, an expensive high-vacuum relay should be used for opening the conductor in the high voltage circuit. However, even though an expensive vacuum relay is used, it may still be subject to unreliability.

The reduced voltage approach to providing a low power level in a microwave oven has appeared in a number of forms. One form is a variable resistance connected directly in series with the anode current supplied to the magnetron. A disadvantage of this first form is that when it is applied to a conventional ferroresonant transformer half-wave doubler power supply, either the magnetron anode and the first terminal of the high voltage winding cannot both be grounded, as is convenient and conventional, or the variable resistance must be connected at a point in the circuit where both terminals of the variable resistance are at a high voltage, creating practical insulation and safety problems.

A second form is a variable inductance connected in series with either the primary or the high voltage winding. Such an inductance is expensive and bulky. A third form is varying the value of the capacitor included in the half-wave doubler by switching parallel capacitors in and out of the circuit. This approach is difficult to implement and has been found to be less than satisfactory. In order to switch a capacitor in and out of the circuit the switching must be done at a relatively high voltage, thereby placing stringent insulation requirements on a switch used to accomplish this result.

A fourth form of the reduced voltage approach is applicable when the high voltage DC supply includes a full-wave voltage quadrupler or a full-wave voltage doubler, instead of a half-wave doubler. A switch may be provided to selectively change a full-wave voltage quadrupler configuration to a full-wave voltage doubler configuration or to selectively change a full-wave voltage doubler configuration to a full-wave rectifier configuration, thereby reducing the voltage to one-half the full voltage. Alternatively, a full-wave doubler could be selectively changed to a half-wave doubler configuration. However, this fourth form sacrifices the simplicity of the half-wave doubler and provides only a single level of reduced voltage which may not be optimum for providing a desired level of reduced power.

SUMMARY OF THE INVENTION

Accordingly, it is an object of the invention to provide simple, effective and inexpensive apparatus for varying the power level of microwave energy produced by a magnetron in a microwave oven.

It is another object of the invention to provide such apparatus which eliminates the need for a separate filament transformer for supplying power to the magnetron heater.

It is another object of the invention to provide such apparatus which, when less than full power operation is desired, provides continuous reduced heating power so that cyclic variations in the heating of food being cooked do not occur.

It is another object of the invention to provide such apparatus in which one terminal of the high voltage secondary winding of a conventional ferroresonant transformer, the magnetron anode, and one terminal of a variable resistance included in the apparatus may each be grounded.

It is another object of the invention to provide such apparatus which simple and inexpensive to implement while accomplishing all of the above objects.

These and other objects are accomplished by the invention which includes a magnetron and a high voltage variable DC power supply therefor, the power supply being generally of the conventional ferroresonant transformer half-wave voltage doubler type including a capacitor and a rectifier connected in a well-known manner, but further including a variable resistance connected in series with the rectifier. During positive half-cycle AC line voltage excursions, the charging current for the capacitor, and thus the maximum voltage to which the capacitor charges, is controlled by the value of the resistance connected in series with the rectifier. During negative half-cycle AC line voltage excursions, the sum of the voltage produced at the second terminal of the high voltage winding and the voltage across the capacitor, and thus the voltage supplied to the magnetron will be less than if the capacitor were fully charged. If only two power levels are required, for example, full power and half power, a single fixed resistor may be connected in series with the rectifier and a switch may be connected across the terminals of the reisitor. For full power operation the switch is closed, so that the resistor is shorted out, permitting maximum charging of the capacitor. For half power operation the switch is opened so that the resistor is placed in series with the rectifier, thereby reducing charging of the capactor. The variable resistance is connected between the rectifier cathode and the first terminal of the secondary winding of the power transformer so that a terminal of the variable resistance may be at ground potential.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENTS

Figure 1:
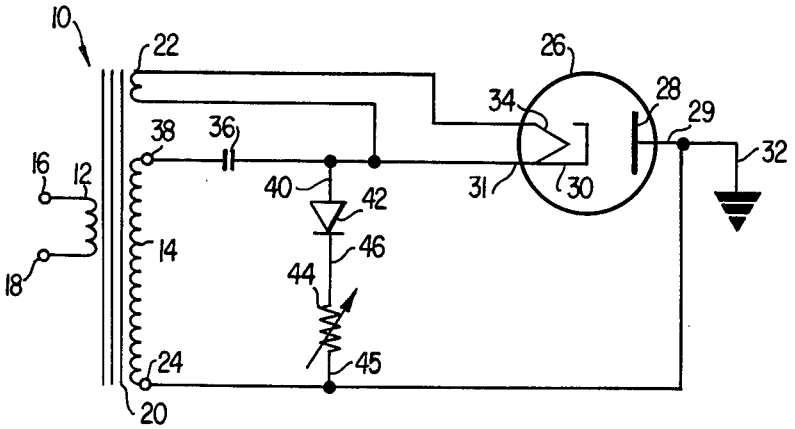
FIG. 1 shows a schematic diagram of apparatus including a first embodiment of the invention.

Referring first to FIG. 1, there is shown a power transformer 10 which includes a primary winding 12 and a high voltage secondary winding 14. The primary winding 12 has two terminals 16 and 18 for connection to a source of AC power (not shown), typically a 120 volt, 60 Hertz commercial power line. In order to control the application of power to the primary winding 12, conventional oven control circuitry (not shown) such as interlock switches and a timer is interposed between the source of AC power and the terminals 16 and 18. The transformer 10 is preferably of the high leakage reactance ferroresonant voltage regulating type in which the primary winding 12 and the high voltage secondary winding 14 are loosely coupled together by winding them side-by-side on a common core 20 with an iron shunt (not shown) between them. A low voltage secondary winding 22, consisting of a small number of turns of heavy wire, is wound over the primary winding 12. As is conventional, a first terminal 24 of the high voltage winding 14 is adapted for connection to ground potential.

A magnetron 26 for producing microwave energy, preferably at a frequency of 2450 MHz, includes an anode 28 and a cathode 30, the cathode 30 being of the indirectly heated type. The magnetron 26 is of the conventional grounded anode type, so a magnetron anode terminal 29 is connected to ground potential by a ground connection 32. The magnetron 26 includes a separate cathode heater 34, which is connected to receive power from the low voltage winding 22.

The first terminal 24 of the high voltage winding 14 is connected to the magnetron anode terminal 29, preferably through connection to a common ground is a well-known manner. One terminal of a capacitor 36 is connected to a second terminal 38 of the high voltage winding 14. The other terminal of the capacitor 36 and the anode 40 of a rectifier 42 are connected to a magnetron cathode terminal 31. In order to vary the charging of the capacitor 36 during charging half-cycle AC line excursions, and thus to vary the voltage supplied to the magnetron 26, a variable resistor 44 is connected between the cathode 46 of the rectifier 42 and the magnetron anode terminal 29, a terminal 45 of the variable resistor 44 being connected to the magnetron anode terminal 29. Since the magnetron anode terminal 29 is grounded, the terminal 45 is grounded.

Figure 2:
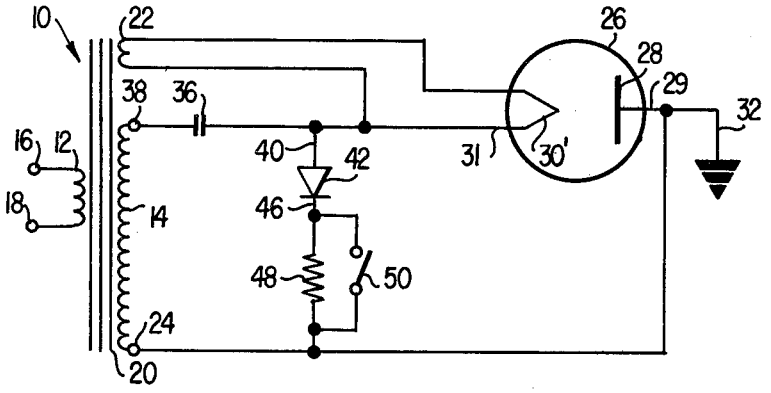
FIG. 2 shows a schematic diagram of apparatus including a second embodiment of the invention.

Referring now to FIG. 2, the variable resistor 44 in the apparatus of FIG. 1 is replaced by a fixed resistor 48 and a switch 50 connected in parallel with the resistor 48. The switch 50 may be ganged with other switches (not shown) which may be used, for example, to energize pilot lights (not shown) to indicate whether the oven is in a "cook" or in a "defrost" mode. Additionally, in FIG. 2, the separate magnetron cathode 30 and heater 34 of FIG. 1 are, for illustrative purposes, replaced by their equivalent, a directly heated cathode 30'.

Figure 3:
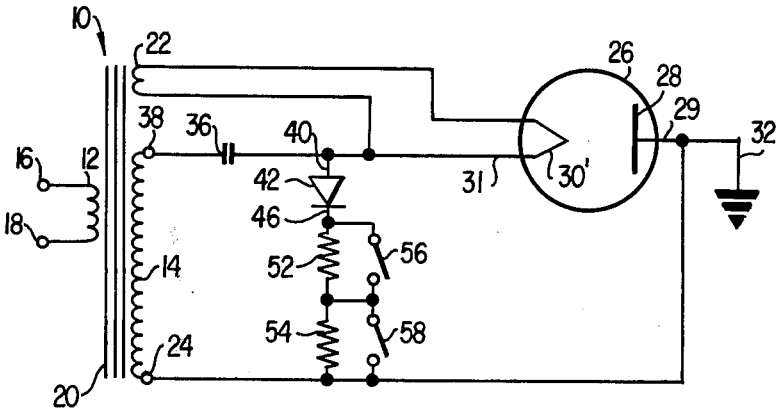
FIG. 3 shows a schematic diagram of apparatus including a third embodiment of the invention.

Referring now to FIG. 3, the variable resistor 44 in the apparatus of FIG. 1 is replaced by series-connected fixed resistors 52 and 54 and switches 56 and 58 connected in parallel with the resistors 52 and 54 for selectively shorting the resistors 52 and 54. The switches 56 and 58 may, for example, be part of a three button ganged push-button switch assembly (not shown) for selecting any one of three power levels. As in FIG. 2, the separate magnetron cathode 30 and heater 34 of FIG. 1 are, for illustrative purposes, replaced by ther equivalent, the directly heated cathode 30'.

Figure 4:
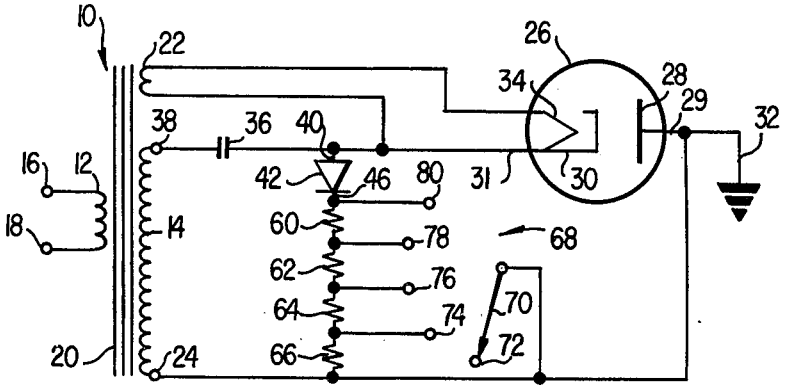
FIG. 4 shows a schematic diagram of apparatus including a fourth embodiment of the invention.

Referring now to FIG. 4, the variable resistor 44 in the apparatus of FIG. 1 is replaced by series-connected resistors 60, 62, 64 and 66 and a rotary tap switch 68 for progressively shorting the resistors 60, 62, 64 and 66, beginning with the resistor 66. In order to avoid surges of full power operation as the position of a movable contact 70 of the tap switch 68 is changed, the tap switch 68 is of the make-before-break, also known as "shorting," type. In addition to the movable contact 70, the tap switch 68 includes fixed contacts 72, 74, 76, 78 and 80. The contact 72 is left unconnected. The contact 74 is connected to the junction of the resistors 64 and 66, the contact 76 is connected to the junction of the resistors 62 and 64, the contact 78 is connected to the junction of the resistors 60 and 62, and the contact 80 is connected to the junction of the rectifier cathode 46 and the resistor 60.

The operation of the embodiments of the invention which are described above with reference to FIGS. 1, 2, 3 and 4 will now be explained. When AC voltage is supplied to the terminals 16 and 18, and thus the primary winding 12, high voltage AC voltage is produced by the high voltage winding 14 and appears across the terminals 24 and 38. In order to provide voltage regulation, the ferroresonant transformer 10 cooperates with the capacitor 36 to achieve a resonant condition and resultant magnetic saturation of the core 20. The high voltage winding 14, the capacitor 36 and the rectifier 42 cooperate to produce half-wave high voltage pulses for supplying the magnetron 26, the peak voltage supplied to the magnetron 26 being a function of the amount of resistance in series with the rectifier 42.

Referring particularly to FIG. 1, assuming the variable resistor 44 is adjusted to have substantially zero resistance, the half-wave voltage doubler circuit comprising the capacitor 36 and the rectifier 42 operates conventionally to produce half-wave high voltage DC pulses having a peak voltage approximately equal to the peak voltage produced by the high voltage winding 14. During positive half-cycle AC line excursions, that is during those portions of the AC cycle when the voltage at the terminal 38 is positive with reference to the voltage at the terminal 24, the capacitor 36 charges through the rectifier 42 up to a voltage approximately equal to the peak voltage across the high voltage winding 14. The capacitor terminal connected to the terminal 38 receives a positive voltage with reference to the capacitor terminal connected to the rectifier anode 40. During positive half-cycle AC line excursions, the magnetron 26 does not conduct because the magnetron 26 itself displays rectifying diode characteristics and, unless its breakdown voltage is exceeded, current will not flow through the magnetron 26 from the cathode 30 to the anode 28 and further because the voltage across the magnetron 26 is maintained at a relatively low value due to a shunting effect of the rectifier 42.

During negative half-cycle AC line excursions, that is during those portions of the AC cycle when the voltage at the terminal 38 is negative with reference to the voltage at the terminal 24, the rectifier 42 is reversebiased and not conducting. Since the high voltage winding 14 and the capacitor 36 are connected in series, the voltage across the high voltage winding 14 is added to the voltage which was stored in the capacitor 36 during the positive half-cycle AC line excursion to produce a voltage across the magnetron cathode terminal 31 and anode terminal 29 equal to the sum of the voltage across the high voltage winding 14 and the capacitor 36, the sum voltage being approximately equal to twice the peak voltage produced by the high voltage winding 14. Assuming sufficient voltage is produced across the magnetron cathode terminal 31 and the anode terminal 29, the magnetron 26 conducts during negative half-cycle AC line excursions because the cathode 30 is negative with respect to the anode 28. Because the capacitor 36 partially discharges through the magnetron 26 during negative half-cycle AC line excursions, the voltage stored in the capacitor 36 will not be maintained at its peak over an entire negative half-cycle excursion. Therefore, even when the capacitor 36 is initially charged up to nearly the peak voltage produced by the high voltage winding 14, the sum of the voltages across the high voltage winding 14 and the capacitor 36, and thus the high voltage supplied to the magnetron 26 when the negative half-cycle AC line voltage reaches its peak, will be somewhat less than twice the peak voltage across the high voltage winding 14.

Considering now the operation of the variable power level feature of the present invention, if the variable resistor 44 (FIG. 1) is adjusted to insert resistance in series with the rectifier 42, during positive half-cycle AC line excursions the charging current for the capacitor 36, and thus the maximum voltage up to which the capacitor 36 charges, is limited and controlled by the value of the resistor 44. Since a lower voltage is stored in the capacitor 36 than if the resistor 44 had substantially zero resistance, during negative half-cycle AC line excursions the sum of the voltage appearing at the terminal 38 and the voltage across the capacitor 36 is less than if the capacitor 36 were fully charged. Thus, a lower voltage is supplied to the magnetron 26. It will be apparent, therefore, that the pulsating DC high voltage supplied to the magnetron 26 during negative half-cycle AC line excursions is an inverse function of the value of the resistor 44. Since the microwave output power level of the magnetron 26 is a direct function of the voltage supplied to it, the microwave power level will be an inverse function of the value of the resistor 44.

If only two levels of power are desired, for example, a full power level and a half power level, the embodiment of the invention shown in FIG. 2 may be employed. When the switch 50 of FIG. 2 is closed, the resistor 48 is shorted and the effective resistance in series with the rectifier 42 is substantially zero. As will be apparent from the discussion based on FIG. 1 above, full high voltage is supplied to the magnetron 26 and maximum microwave output power level is produced. When the switch 50 is opened, the resistor 48 is effectively connected in series with the rectifier 42, resulting in reduced charging current for the capacitor 36, reduced voltage on the capacitor 36, and therefore reduced voltage supplied to the magnetron 26, resulting in reduced microwave power output therefrom.

If three discrete power levels are desired, for example "high," "medium," and "low," the embodiment shown in FIG. 3 may be employed. In the high power mode, both the switches 56 and 58 are closed, thereby shorting both the resistors. In the medium power mode, only the switch 56 is closed, thereby shorting the resistor 52 and placing the resistor 54 in series with the rectifier 42. In the low power mode, the switches 56 and 58 are both open, thereby placing both the resistors 52 and 54 in series with the rectifier 42.

If a greater number of discrete power output levels are desired, the embodiment of the invention illustrated in FIG. 4 may be employed. As will be apparent, the position of the movable contact 70 will determine the amount of resistance placed in series with the rectifier 42, thereby controlling the high voltage supplied to the magnetron 26 during negative half-cycle AC line excursions.

It will be apparent, therefore, that the present invention provides simple, effective and inexpensive apparatus for varying the power level produced by a magnetron in a microwave oven.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

For example, a first modification of the embodiment shown in FIG. 1 could be accomplished by connecting the capacitor 36 between the terminal 24 and the junction of the terminal 45 of the variable resistor 44 and the magnetron anode terminal 29, and by directly connecting the terminal 38 to the junction of the rectifier anode 40 and the magnetron cathode terminal 31. A second modification of the embodiment of the invention shown in FIG. 1 could be accomplished by switching the positions of the rectifier 42 and the variable resistor 44, while maintaining the polarity of the rectifier 42 with respect to the magnetron 26. Either or both of these modifications would maintain the series-connected relationship of the rectifier 42 and the variable resistor 44 and would maintain the general half-wave doubler configuration. However, each of these modifications has the disadvantage that one terminal of the high voltage winding 14, the terminal 45 of the variable resistor 44, and the magnetron anode terminal 29 could not all simultaneously be grounded. It will be apparent that either or both of these modifications could similarly be applied to any of the embodiments of the invention shown in FIGS. 2, 3 and 4.

What is claimed as the invention is:

1. In a microwave oven, variable power level apparatus comprising:

a. a magnetron for producing microwave energy, said magnetron having anode and cathode terminals with the magnetron anode terminal conneted to ground potential;

b. a capacitor;

c. a power transformer including a primary winding having terminals for connection to an AC power source and a high voltage secondary winding having two terminals, one of said high voltage secondary winding terminals being connected through said capacitor to the magnetron cathode terminal and the other of said high voltage secondary winding terminals being connected to ground potential and thereby connected to the magnetron anode terminal;

d. a rectifier having its anode terminal connected to the junction of said capacitor and the magnetron cathode terminal; and e. a variable resistance means connected in series with said rectifier between the rectifier cathode terminal and ground potential.

2. The apparatus of claim 1, wherein said power transformer further includes a low voltage secondary winding and a heater for said magnetron cathode is connected across said low voltage secondary winding.

3. The apparatus of claim 1, wherein said power transformer further includes a low voltage secondary winding and said magnetron cathode is of the directly heated type and is connected across said low voltage secondary winding.

4. The apparatus of claim 1, wherein said variable resistance means comprises a resistor and a shorting switch connected across said resistor.

5. The apparatus of claim 1, wherein said variable resistance means comprises a pair of series-connected resistors and a pair of switches for selectively shorting said resistors.

6. The apparatus of claim 1, wherein said variable resistance means comprises a plurality of series-connected resistors and a tap switch for progressively shorting said resistors.

7. The apparatus of claim 1, wherein the one of said high voltage secondary winding terminals is connected through said capacitor to said magnetron cathode terminal and the other of said high voltage secondary winding terminals is connected to said magnetron anode terminal.

8. The apparatus of claim 7, wherein the other of said high voltage secondary winding terminals and said magnetron anode terminal are connected to ground potential.

9. The apparatus of claim 8, wherein one terminal of said variable resistance means is connected to said magnetron anode terminal, whereby said one terminal of said variable resistance means is at ground potential.

10. The apparatus of claim 1, wherein said power transformer is a ferroresonant voltage regulating transformer cooperating with said capacitor to achieve a resonant condition.

* * * * *

UNITED STATES PATENT OFFICE
CERTIFICATE OF CORRECTION

PATENT NO. : 4,017,702
DATED : April 12, 1977
INVENTOR(S) : Larry R. Harmon and Donald J. Simon It is certified that error appears in the above-identified patent and that said Letters Patent are hereby corrected as shown below:

In Column 8, delete lines 50 through 65.

In Column 9, delete lines 1 through 14.

In Column 10, delete lines 21 through 38 (Claims 7 through 10).

Signed and Sealed this

*fifth* Day of *July 1977*

[SEAL]

*Attest:*

RUTH C. MASON
*Attesting Officer*

C. MARSHALL DANN
*Commissioner of Patents and Trademarks*